US005291866A

United States Patent [19]

Kosa

[11] Patent Number: 5,291,866

[45] Date of Patent: Mar. 8, 1994

[54] PULSE CHARGER

[76] Inventor: David R. Kosa, 10575 Swan Creek, Carleton, Mich. 48117

[21] Appl. No.: 94,939

[22] Filed: Jul. 20, 1993

[51] Int. Cl.[5] ..... F02B 75/02

[52] U.S. Cl. ..... 123/317; 123/73 V

[58] Field of Search ..... 123/317, 73 V

[56] References Cited

U.S. PATENT DOCUMENTS 3,859,968 1/1975 Stinebough ..... 123/317

3,973,532 8/1976 Litz ..... 123/317

OTHER PUBLICATIONS

"Reeds that will wake up your engine", B.A.S.S. Times, Don Wirth, 1989.

"Efficient Reed Induction", Powerboat Magazine, Nov./Dec. 1988.

*Primary Examiner*—Noah P. Kamen

*Attorney, Agent, or Firm*—Harness, Dickey & Pierce

[57] ABSTRACT

An apparatus for supercharging a four cycle internal combustion engine has at least one inlet reed or check valve and at least one outlet reed or check valve associated with each cylinder of the internal combustion engine. The crankcase of the engine is maintained air tight and if the engine is multi-cylindered, the crankcase must be provided with some form of air tight separation between each cylinder inside the crankcase. When the engine is rotating, each up-stroke of each piston causes an air charge to enter the respective crankcase section for that cylinder through its associated inlet reed or check valve. Each down-stroke of the piston causes compression of the charge in the associated section of the crankshaft and delivery of this pressurized charge through the associated outlet reed or check valve. The outlet reed or check valve is in communication with the carburetor or fuel injection system of the engine to provide this supercharged charge to the intake system of the internal combustion engine thus supercharging the engine.

20 Claims, 5 Drawing Sheets

PULSE CHARGER

FIELD OF THE INVENTION

The present invention relates to a pulse charger. More particularly, the present invention relates to a pulse charger for use with an internal combustion engine to provide a supercharging to the intake system of the internal combustion engine.

BACKGROUND AND SUMMARY OF THE INVENTION

Superchargers in the form of air pumps or blowers are well known for the intake system of an internal combustion engine. Their purpose is to increase the air charge weight and thus the power output from a given engine size.

Superchargers for engines which are used in stationary, automotive, aircraft and marine applications are generally designed as a positive displacement blower of the piston or Roots type. These positive displacement blowers are normally driven from the engine crankshaft. Because the volume delivery of these types of blowers varies linearly with the engine speed, the cylinder pressure and shaft torque are reasonably constant throughout the speed range. Typically, a gain in air charge and horsepower in the area of one-third or higher may be realized over a naturally aspirated engine of the same size. This horsepower increase is dependent on the boost pressure for the engine equipped with the blower.

On diesel or compression ignition applications, the increased air content produced by the supercharger allows the engine to burn more fuel and produce greater horsepower without creating excessive pressures inside the cylinder. In the case of the diesel engine, supercharging makes ignition of the fuel easier due to the compression of the intake air by the supercharger which raises the air charge temperature.

Four cycle and some two cycle engines often require some form of blower or air charger similar to the superchargers mentioned above to assist in charging the cylinder during the intake phase. If the air pressure in the cylinder at the beginning of the compression stroke is substantially above atmospheric pressure, the engine is then said to be supercharged.

The present invention provides the art with an apparatus for supercharging an internal combustion engine. The apparatus has at least one individual inlet reed or check valve and at least one individual outlet reed or check valve for each cylinder in the internal combustion engine. The crankcase of the engine is maintained air tight and if the engine is multi-cylindered, the crankcase must be provided with some form of air tight separation between each cylinder inside the crankcase. When the engine is rotating, each up-stroke of each piston causes an air charge to enter the crankcase section for that cylinder through its associated inlet reed. Each down-stroke of the piston causes compression of the charge in the associated section of the crankshaft and delivery of this pressurized charge through the associated outlet reed. The outlet reed is in communication with the carburetor or intake system of the engine to provide this supercharged charge to the internal combustion engine thus supercharging the engine.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

The pulse charger of the present invention will be described for exemplary purposes in conjunction with a single cylinder four-stroke internal combustion engine having a vertical crankshaft. As will be described below, the pulse charger of the present invention may be incorporated into multi-cylinder four-stroke internal combustion engines as well as the single cylinder four-stroke engine described.

Figure 1:
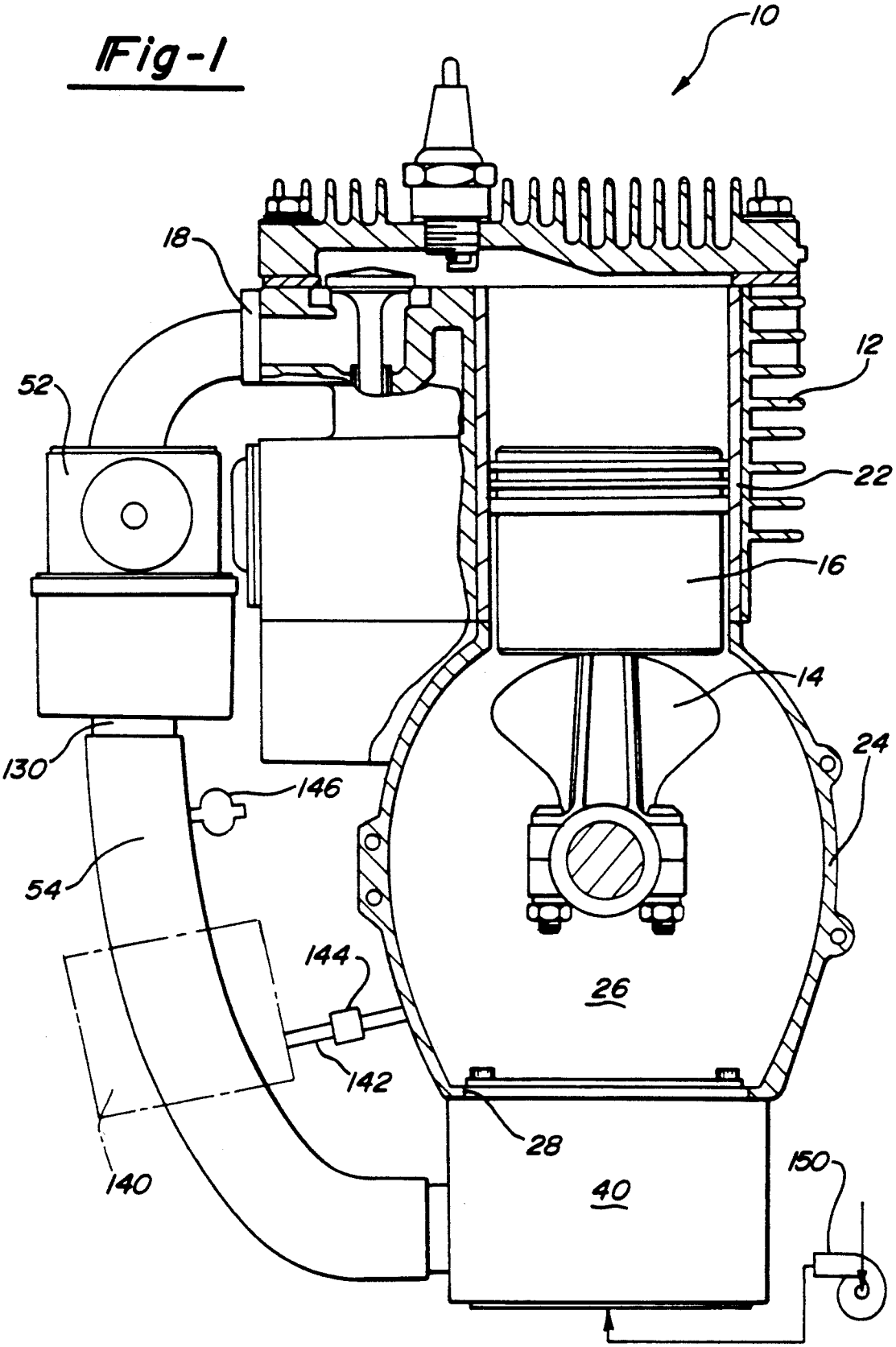
FIG. 1 is a partially cutaway side elevation view of a single cylinder internal combustion engine having a pulse charger in accordance with the present invention.
Figure 2:
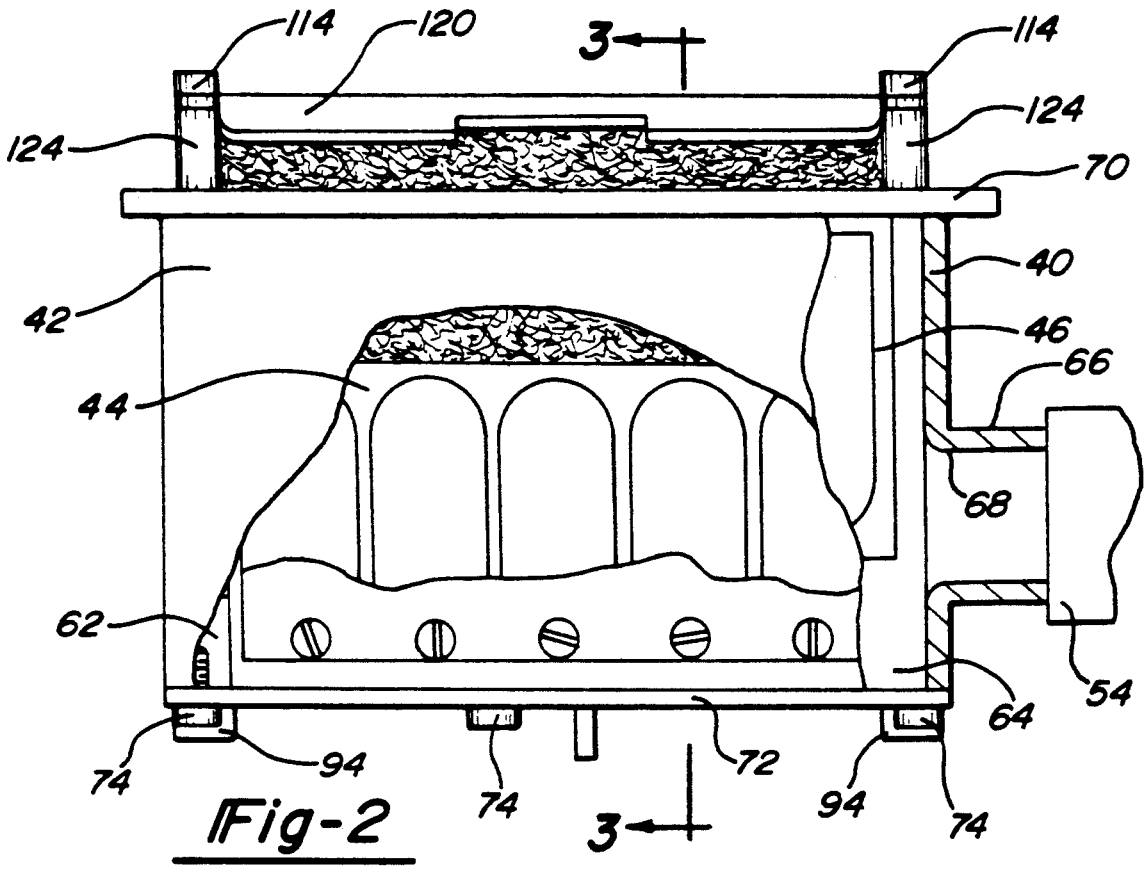
FIG. 2 is a partially cutaway longitudinal elevation side view of the pulse charger in accordance with the present invention.
Figure 3:
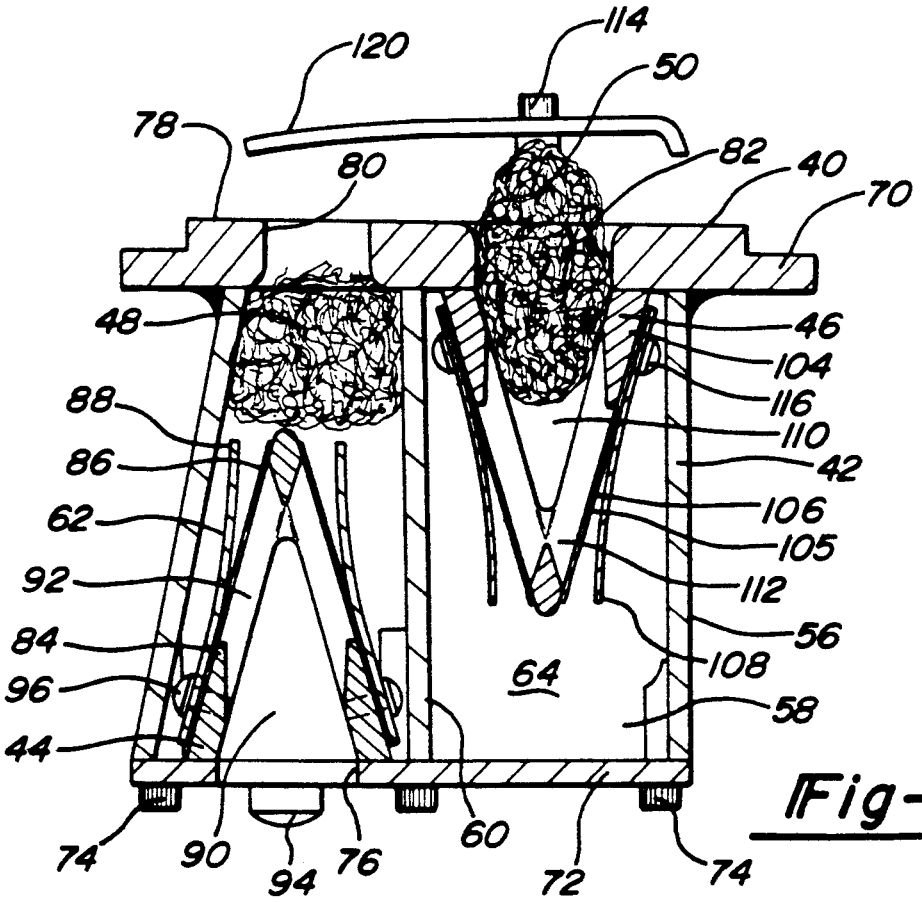
FIG. 3 is a cross-sectional side elevation view of the pulse charger in accordance with the present invention.

Referring now to the drawings in which like reference numerals designate like or corresponding parts throughout the several views, there is shown in FIG. 1, a single cylinder four-stroke internal combustion engine 10. Internal combustion engine 10 is illustrated incorporating a pulse charger 40 of the present invention. Engine 10 comprises an engine block 12, a vertical crankshaft 14, a piston 16, an intake system 18 and an exhaust system (not shown). Engine block 12 includes a cylinder block 22 and a crankcase 24 defining an internal cavity 26. Internal cavity 26 is sealed from the outside environment. As shown in FIG. 1, crankshaft 14 is vertically disposed within cavity 26 of crankcase 24. Crankcase 24 further defines a through opening 28 into which a pulse charger 40 is fixedly secured by mounting bolts (not shown) or other means known well in the art. Pulse charge 40 may also be formed or cast as an integral portion of engine block 12 or crankcase 24.

Figure 6:
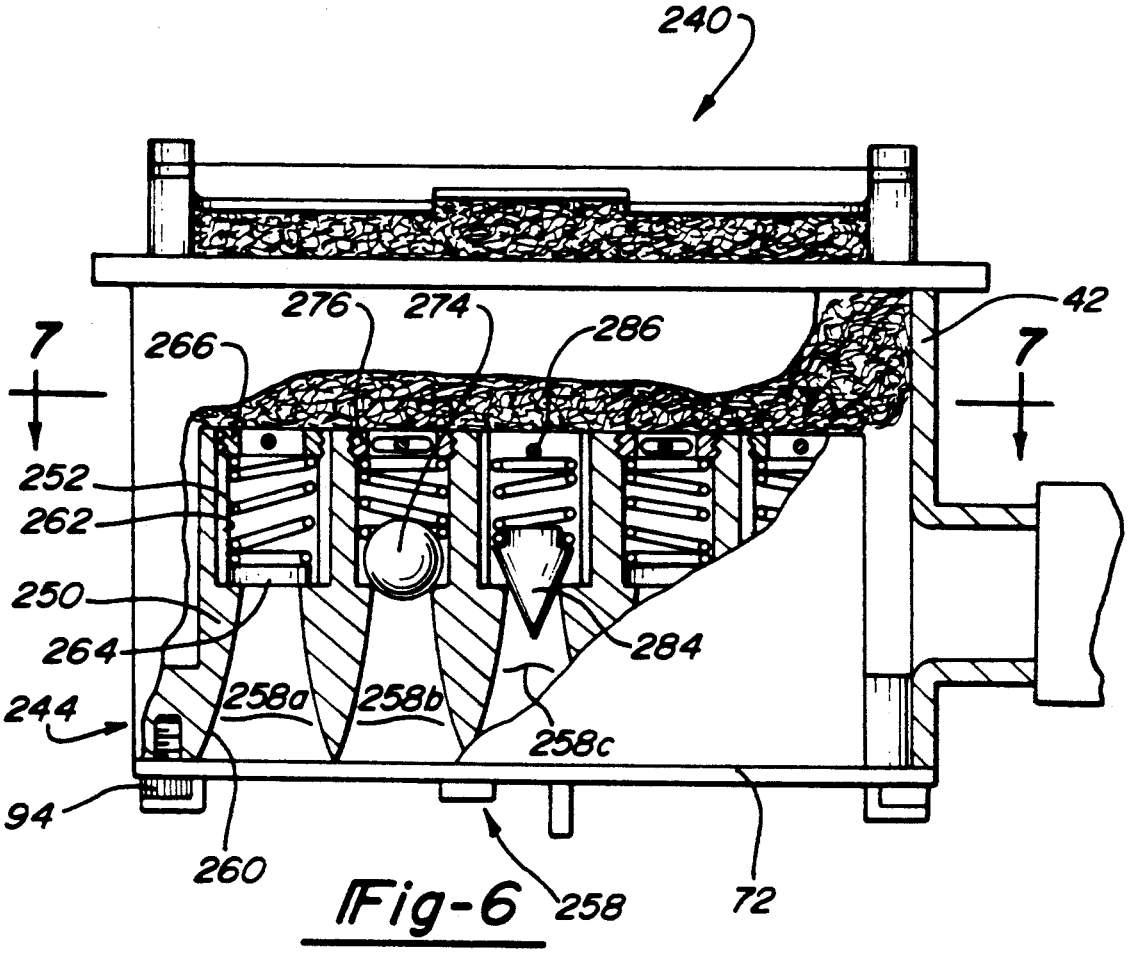
FIG. 6 is a partially cut away side elevational view of a pulse charger in accordance with another embodiment of the present invention.
Figure 7:
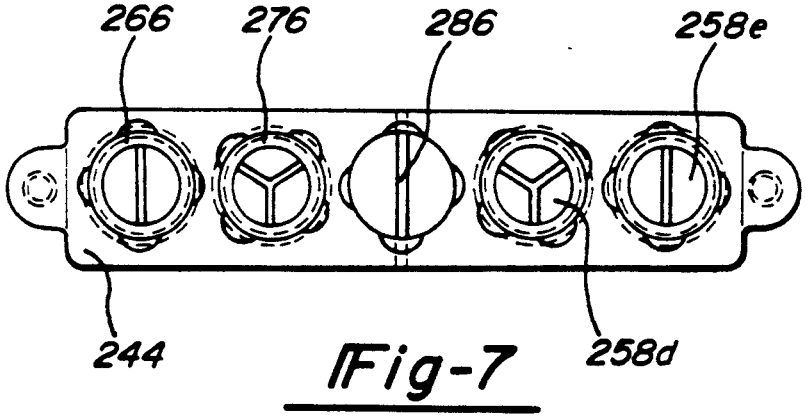
FIG. 7 is a top view of the inlet check valve assembly of the pulse charger of FIG. 6 taken in direction 7—7 of FIG. 6.

Pulse charger 40 comprises a housing 42, an inlet reed assembly 44, an outlet reed assembly 46, an air inlet filter 48, an air outlet filter 50, a carburetor or fuel injection system 52 and a hose 54 connecting housing 42 to carburetor or fuel injection system 52. While the detailed description for exemplary purposes will be described as having inlet reed assembly 44 and outlet reed assembly 46, it is well within the scope of the present invention to use other types of one-way valve systems including one-way check valves as shown in FIGS. 6 and 7 in place of inlet reed assembly 44 or outlet reed assembly 46 if desired.

Housing 42 comprises a generally hollow rectangular body 56 defining an internal cavity 58 and having an internal web 60 separating internal cavity 58 into an inlet cavity 62 and an outlet cavity 64. Attached to one side of body 56 adjacent outlet cavity 64 is a hollow cylindrical outlet tube 66. The interior of outlet tube 66 is in communication with outlet cavity 64 through opening 68 and is adapted for attachment of hose 54 to housing 42. A cover 72 is fixedly secured to the outside edge of housing 42 by a plurality of mounting bolts 74 or other means known well in the art. Cover 72 operates to seal outlet cavity 64 from the outside environment and is provided with an opening 76 which allows communication between the outside environment and inlet cavity 62. The end of housing 42 opposite to cover 72 is provided with a wall 78 which is fixedly secured to housing 42 by welding, brazing or other means known well in the art. Wall 78 is disposed within opening 28 of crankcase 24 and includes an inlet opening 80 which allows communication between inlet cavity 62 and internal cavity 26 and an outlet opening 82 which allows communication between internal cavity 26 and outlet cavity 64. An attachment flange 70 surrounds wall 78 and is adapted for securing pulse charger 40 to crankcase 24 by mounting bolts (not shown) when pulse charger 40 is not an integral member of crankcase 24 or engine block 12.

Figure 4:
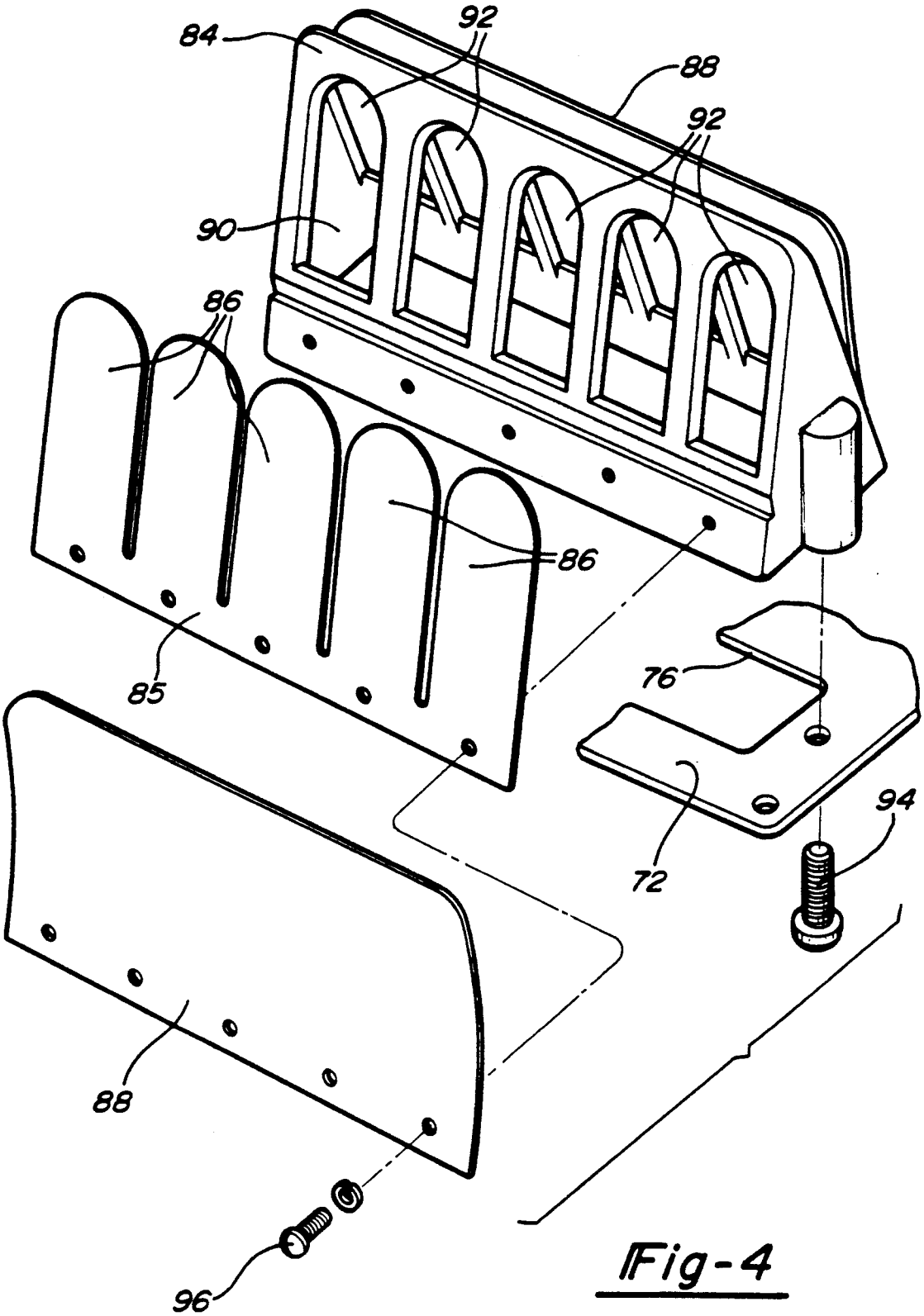
FIG. 4 is an exploded perspective view of a reed assembly of the pulse charger in accordance with the present invention.

Inlet reed assembly 44 is shown in an exploded view in FIG. 4 and comprises a reed mounting housing 84, a pair of reed inserts 85 each having a plurality of reeds 86 and a pair of backup plates 88. Inlet reed mounting housing 84 is a hollow generally triangular shaped housing defining an internal chamber 90 and a plurality of through openings 92 disposed on opposite sides of the triangular faces of housing 84. Each of the plurality of through openings 92 is covered by a respective reed 86. The plurality of through openings on each side of housing 84 is thus covered by the plurality of reeds 86 of a respective reed insert 85 and each reed insert 85 is secured to housing 84 at the end nearest cover 72 by a plurality of bolts 96. Each reed 86 thus forms a one-way valve which will allow fluid flow from internal chamber 90 through a respective through opening 92 by the deflection of reed 86 but will not allow fluid flow in the opposite direction. Each triangular face of housing 84 is also provided with a respective backup plate 88 which extends the length of housing 84 to act as both a protective cover for reeds 86 as well as a support for reeds 86 to restrict any excessive bending motion. Backup plates 88 are also secured to housing 84 by the plurality of bolts 96. While the preferred embodiment is being described as having a plurality of reeds 86 and a plurality of through openings 92, it is within the scope of the present invention to provide only a single reed 86 and a single through opening 92 if desired.

Inlet reed assembly 44 is fixedly secured to cover 72 by a plurality of bolts 94 threadably engaging housing 84 or by other means known well in the art such that housing 84 is disposed between opening 76 in cover 72 and opening 80 in wall 78. This locates inlet reed assembly 44 within inlet cavity 62 of housing 42 such that internal chamber 90 of housing 84 is in communication with opening 76 in cover 72. Thus, the external environment is in communication with internal cavity 26 through opening 76 in cover 72, through internal chamber 90 of housing 84, through openings 92 and past reeds 86 into inlet cavity 62 and through inlet opening 80 in wall 78 into internal cavity 26. Fluid flow in the opposite direction, from internal cavity 26 to the external environment is prohibited by the operation of reeds 86. Inlet air filter 48 is located within inlet cavity 62 between inlet reed assembly 44 and wall 78 of housing 42 to filter out any contaminants found in the external environment.

Outlet reed assembly 46 is similar to inlet reed assembly 44 and comprises a reed mounting housing 104, a pair of reed inserts 105 each having a plurality of reeds 106 and a pair of backup plates 108. Outlet reed mounting housing 104 is a hollow generally triangular shaped housing defining an internal chamber 110 and a plurality of through openings 112 disposed on opposite sides of the triangular side faces of housing 104. Each of the plurality of through openings 112 is covered by a respective reed 106. The plurality of through openings on each side of housing 104 is thus covered by the plurality of reeds 106 of a respective reed insert 105 and each reed insert 105 is secured to housing 84 at the end nearest wall 78 by a plurality of bolts 116. Each reed 106 thus forms a one-way valve which will allow fluid flow from internal chamber 110 through a respective through opening 112 by the deflection of reed 106 but will not allow fluid flow in the opposite direction. Each triangular face of housing 104 is also provided with a respective backup plate 108 which extends the length of housing 104 to act as both a protective cover for reeds 106 as well as a support for reeds 106 to restrict any excessive bending motion. Backup plates 108 are also secured to housing 104 by the plurality of bolts 116. While the preferred embodiment is being described as having a plurality of reeds 106, it is within the scope of the present invention to provide only a single reed 106 and a single through opening 112 if desired.

Outlet reed assembly 46 is fixedly secured to wall 78 by a plurality of bolts 114 threadably engaging housing 140 or by other means known well in the art such that housing 104 is disposed between outlet opening 82 in wall 78 and cover 72 of housing 42. This locates outlet reed assembly 46 within outlet cavity 64 of housing 42 such that internal chamber 110 of housing 104 is in communication with outlet opening 82 in wall 78. Thus, internal cavity 26 is in communication with the interior of outlet tube 66 through outlet opening 82 in wall 78 into internal chamber 110 of housing 104, through openings 112 and past reeds 106 into outlet cavity 64 and through opening 68 in housing 42 into the interior of outlet tube 66. Fluid flow in the opposite direction, from the interior of outlet tube 66 to internal cavity 26, is prohibited by the operation of reeds 106. Outlet air filter 50 is located within outlet opening 82 in wall 78 to filter any contaminants found in the internal cavity 26 of crankcase 24.

A baffle 120 is fixedly secured to pulse charger 40 by the plurality of bolts 114. Baffle 120 is spaced away from wall 78 by a plurality of spacers 124. Baffle 120 aids in keeping any liquid from entering outlet cavity 64 and assists in retaining outlet air filter 50 within outlet opening 82.

Carburetor or fuel injection system 52 is sealingly secured to intake system 18. Attached to one side of carburetor or fuel injection system 52 is pressure box 130. The interior of pressure box 130 is in communication with intake system 18 and is adapted for attachment of hose 54. Hose 54 is sealingly attached at one end to outlet tube 66 of housing 42 and is sealingly attached at the opposite end to pressure box 130 to provide fluid communication between outlet cavity 64 of housing 42 intake system 18. An additional oil separator 140 shown in phantom in FIG. 1 may also be included in order to separate crankcase oil from the pulsed air charge prior to the pulsed air charge entering carburetor or fuel injection system 52. Oil separator 140 can be of the centrifugal type, the baffle type or any other type of separator known in the art. An oil return tube 142 is connected between oil separator 140 and crankcase 24 to return the separated oil. A check valve 144 prohibits the movement of the pulsed charge between oil separator 140 and crankcase 24.

The operation of pulse charger 40 will be described with piston 16 being located within cylinder block 22 at the end of a down-stroke which is also the beginning of an upstroke. As piston 16 moves through an upstroke, a vacuum is created within internal cavity 26 of crankcase 24. The vacuum causes air located in the environment surrounding pulse charger 40 to enter internal cavity 26 through inlet reed assembly 44. The air moves from the outside environment through opening 76 in cover 72 into internal chamber 90 of housing 84, through openings 92 and past reeds 86 into inlet cavity 62 and through inlet opening 80 in wall 78 into internal cavity 26. This movement of air is caused by the vacuum within internal cavity 26 or the difference in pressure between the outside environment and internal cavity 26 working to open the plurality of reeds 86. Air flow into internal cavity 26 from outlet cavity 64 is prohibited by outlet reed assembly 46. This intake of air into internal cavity 26 continues throughout the upstroke of piston 16. When piston 16 ends its up-stroke and begins its down-stroke, the air within internal cavity 26 begins to be compressed by the downward movement of piston 16. This compressed air is then forced into intake system 18 through outlet reed assembly 46. The air moves from internal cavity 26 through outlet opening 82 in wall 78 into internal chamber 110 of housing 104, through openings 112 and past reeds 106 into outlet cavity 64, through opening 68 in housing 42 into the interior of outlet tube 66, through hose 54 into pressure box 130. The air continues through pressure box 130 into carburetor or fuel injection system 52 and finally into intake system 18. This movement of air is caused by the pressure within internal cavity 26 or the difference in pressure between the interior cavity 26 and intake system 18 working to open the plurality of reeds 106. Air flow from internal cavity 26 into the outside environment is prohibited by inlet reed assembly 44. This outflow of air from internal cavity 26 into intake system 18 continues throughout the down-stroke of piston 16 and operates to provide a supercharging to internal combustion engine 10. In order to limit or control the amount of supercharging or boost, a pop valve 146 may be positioned between pulse charger 40 and carburetor or fuel injection system 52 as shown in FIG. 1. Pop valve 146 would then vent the output of pulse charger 40 at a specified pressure value. Once the down-stroke of piston 16 is complete, piston 16 begins another upstroke and the process is repeated. Thus, the movement of piston 16 in conjunction with pulse charger 40 operates to provide a pulsed supercharging to internal combustion engine 10. In order to increase the amount of pulsed supercharging to internal combustion engine 10, an electrical or mechanical blower 150 can be provided to force additional quantities of air through opening 76 in cover 72 through input reed assembly 44 and into internal cavity 26 if desired. Blower 150 is schematically shown in FIG. 1. A blower which has been successfully used is a 12 volt Par Breeze Junior 105 C.F.M. Model No. H-3286.

While the above detailed description has described pulse charger 40 being secured to crankcase 24 of engine 10, it is well within the scope of the present invention to have pulse charger 40 located cirtually anywhere with respect to engine 10 provided that both inlet opening 80 and outlet opening 82 are in communication with internal cavity 26 of crankcase 24. It is also well within the scope of the present invention to locate the components of pulse charger 40 within internal cavity 26 of crankcase 24 provided that opening 76 is in communication with the outside atmosphere and through opening 68 is in communication with pressure box 130 or its equivalent.

When it is desired to equip a multi-cylinder internal combustion engine with a pulse charging system in accordance with the present invention, it is necessary to separate internal cavity 26 of crankcase 24 into a plurality of sealed cavities. Each of these sealed cavities would correspond to an individual piston or cylinder within the internal combustion engine. The individual cavities must be sealed from the outside environment similar to internal cavity 26, but they must also be sealed from each other in order to eliminate any jumping of the pulse charge between cylinders which would then not generate any positive pressure within the intake system. This sealing of the individual cavities may be done similar to how a current day two cycle crank is sealed or by other methods known well in the art. Once the plurality of sealed cavities are provided, a single pulse charger 40 can be provided for each sealed cavity. The operation of the device for each individual cylinder is then identical to that described above. On multi-cylinder engines which include a pressurized oil system, oil located in each sealed cavity of the crankcase can be returned to an oil sump or oil pump pickup area using one-way check valves or other means known in the art.

Figure 5:
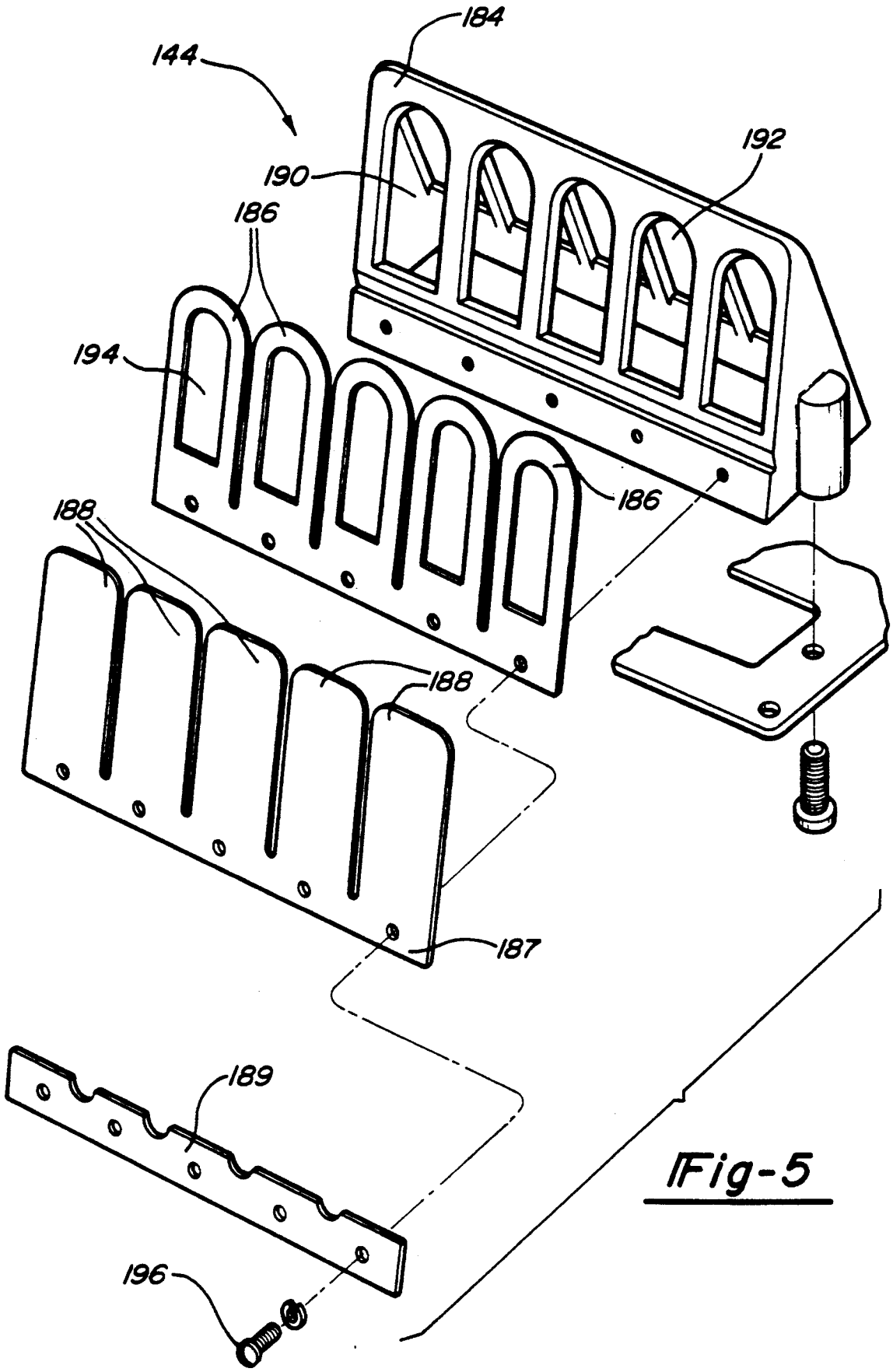
FIG. 5 is an exploded perspective view of a dual-stage reed assembly of the pulse charger in accordance with the present invention.

FIG. 5 illustrates an exploded view of a reed assembly 144 according to another embodiment of the present invention. Reed assembly 144 is a dual-stage reed assembly and may be used as an alternative to inlet reed assembly 44 or outlet reed assembly 46. Reed assembly 144 comprises a reed mounting housing 184, a pair of primary reed inserts 185 each having a plurality of primary reeds 186, a pair of secondary reed inserts 187 each having a plurality of secondary reeds 188 and a pair of rev plates 189. Reed mounting housing 184 is a hollow generally triangular shaped housing defining an internal chamber 190 and a plurality of through openings 192 disposed on opposite sides of the triangular faces of housing 184. Each of the plurality of through openings 192 is covered by both a respective primary reed 186 and a respective secondary reed 188. The plurality of through openings on each side of housing 184 is thus covered by both the plurality of primary reeds 186 of a respective primary reed insert 185 and by the plurality of secondary reeds 188 of a respective secondary reed insert 187. Each primary reed insert 185 and each secondary reed insert 187 are secured to housing 184 by a plurality of bolts 196.

Each primary reed 186 thus forms a one-way valve which will allow fluid flow from internal chamber 190 through a respective through opening 192 by the deflection of primary reed 186 but will not allow fluid flow in the opposite direction. Each primary reed 186 further has a through opening 194 which is covered by a respective secondary reed 188. Each secondary reed 188 thus forms a second one-way valve which will allow fluid flow from internal chamber 190 through a respective through opening 194 by the deflection of secondary reed 188 but will not allow fluid flow in the opposite direction. Thus by varying the stiffness of the primary reeds 186 and the secondary reeds 188, it is possible to control the opening and closing of reed assembly 144 over a broader range of operating pressures. Each triangular face of housing 184 is also provided with a respective rev plate 189 which is secured to housing 184 by the plurality of bolts 196 in order to secure primary reed plate 185 and secondary reed plate 187 in position.

While the preferred embodiment is being described as having a plurality of primary reeds 188, a plurality of secondary reeds 188, and a plurality of through openings 192, it is within the scope of the present invention to provide only a single primary reed 186, a single secondary reed 188 and a single through opening 192 if desired.

Referring now to FIGS. 6 and 7, there is shown a pulse charger 240 according to another embodiment of the present invention. Pulse charger 240 is similar to pulse charger 40 described above with the exception that inlet reed assembly 44 is replaced with an inlet check valve assembly 244. In addition, outlet reed assembly 46 could also be replaced with an outlet check valve assembly (not shown) if desired. The outlet check valve assembly would be similar to inlet check valve assembly 244 similar to the way that outlet reed assembly 46 is similar to inlet reed assembly 44.

Inlet check valve assembly 244 is shown in FIG. 6 assembled into pulse charger 240. Inlet check valve assembly 244 comprises a check valve housing 250, a plurality of coil springs 252 and a plurality of sealing members 254. Inlet check valve housing 250 is a rectangular box shaped housing defining a plurality of through bores 258. Five through bores 258 are shown in FIG. 6 and are identified as 258A through E. Each of the plurality of through bores 258 define a radiused inlet 260 opening into a cylindrical bore 262. The radiused inlet 260 of through bores 258 allows for a smoother flow of air through inlet check valve assembly 244. Disposed within each of the plurality of cylindrical bores 262 are a single coil spring 252 and a single sealing member 254. Inlet check valve assembly 244 is shown with various types of sealing members 254 positioned within the plurality of bores 258 and with various means for retaining coil spring 252 and sealing member 254 within cylindrical bore 262.

Through bore 258A has sealing member 254 shown as a flat disk 264. Flat disk 264 is urged against one end of cylindrical bore 262 by coil spring 252. Coil spring 252 and disk 264 are retained in cylindrical bore 262 by a threaded retainer 266. Threaded retainer 266 is threadably received within cylindrical bore 262 and allows for adjustment of the load being exerted by coil spring 252.

Through bore 258B has sealing member 254 shown as a check ball 274. Check ball 274 is urged against the opening to inlet 260 by coil spring 252. Coil spring 252 and check ball 274 are retained in cylindrical bore 262 by a threaded retainer 276. Threaded retainer 276 is threadably received within cylindrical bore 262 and allows for adjustment of the load being exerted by coil spring 252.

Through bore 258C has sealing member 254 shown as a conical shaped plug 284. Plug 284 is urged against the opening to inlet 260 by coil spring 252. Coil spring 252 and check ball 284 are retained in cylindrical bore 262 by a roll pin 286. Roll pin 286 is press fit between opposite sides of cylindrical bore 262 and thus does not allow for any adjustment of the load exerted by coil spring 252.

While inlet check valve assembly 244 has been shown having various configurations, it is to be understood that the individual check valves within inlet check valve assembly 244 can be identical or can be any combination of the types illustrated or any other type of check valve known in the industry. Also, while the embodiment shown in FIGS. 6 and 7 is being illustrated as having a plurality of check valves, it is within the scope of the present invention to provide only a single check valve disposed within a single through bore 258 if desired.

Inlet check valve assembly 244 is fixedly secured to cover 72 by the plurality of bolts 94 threadably engaging housing 250 or by other means known well in the art similar to the securing of inlet reed assembly 44 to cover 72. Housing 250 is disposed between opening 76 in cover 72 and opening 80 in wall 78. This locates inlet check valve assembly 244 within inlet cavity 62 of housing 42 such that the radiused inlets 260 are in communication with opening 76 in cover 72. Thus, the external environment is in communication with internal cavity 26 through inlets 260, past sealing members 254 and through cylindrical bores 262 into internal cavity 26. Fluid flow in the opposite direction, from internal cavity 26 to the external environment is prohibited by the operation of coil springs 252 and sealing member 254.

As stated above, the outlet check valve assembly (not shown) is similar and operates in a similar manner to inlet check valve assembly 244 and outlet reed assembly 46.

While the above detailed description describes the preferred embodiment of the present invention, it should be understood that the present invention is susceptible to modification, variation and alteration without deviating from the scope and fair meaning of the subjoined claims.

What is claimed is:

1. A pulse charger for an internal combustion engine, said engine having an air intake and a crankcase, said crankcase defining an internal cavity, said pulse charger comprising:

a housing having an inlet port, an outlet port, an inlet opening and an outlet opening, said outlet port being in communication with said air intake of said engine, both said inlet opening and said outlet opening being in communication with said internal cavity defined by said crankcase;

first one-way valve means for allowing fluid flow between said inlet port and said inlet opening, said first one-way valve means being disposed within said housing between said inlet port and said inlet opening; and second one-way valve means for allowing fluid flow between said outlet opening and said outlet port, said second one-way valve means being disposed within said housing between said outlet opening and said outlet port.

2. The pulse charger of claim 1 wherein said first one-way valve means comprises at least one reed valve.

3. The pulse charger of claim 2 wherein said at least one reed valve is a dual-stage reed valve.

4. The pulse charger of claim 1 wherein said first one-way valve means comprises at least one check valve.

5. The pulse charger of claim 1 wherein said second one-way valve means comprises at least one reed valve.

6. The pulse charger of claim 5 wherein said at least one reed valve is a dual-stage reed valve.

7. The pulse charger of claim 1 wherein said second one-way valve means comprises at least one check valve.

8. The pulse charger of claim 1 further comprising means for blowing air into said inlet port of said housing.

9. The pulse charger of claim 1 wherein said housing is fixedly attached to said crankcase of said internal combustion engine.

10. The pulse charger of claim 1 wherein said housing is integral with said crankcase of said internal combustion engine.

11. A pulse charging system for a four cycle internal combustion engine, said engine having a crankcase, a plurality of pistons, and an air intake, said crankcase defining a plurality of cavities, each of said plurality of cavities being associated with a respective piston of said plurality of pistons, said pulse charging system comprising:

a plurality of housings, each housing of said plurality of housings having an inlet port, an outlet port, an inlet opening and an outlet opening, said outlet port being in communication with said air intake of said engine, both said inlet opening and said outlet opening being in communication with a respective cavity of said plurality of cavities defined by said crankcase;

a plurality of first one-way valve means, each first one-way valve means of said plurality of first one-way valve means allowing fluid flow between a respective inlet port and a respective inlet opening, said first one-way valve means being disposed within a respective housing between said respective inlet port and said respective inlet opening; and a plurality of second one-way valve means, each second one-way valve means of said plurality of second one-way valve means allowing fluid flow between a respective outlet opening and a respective outlet port, said second one-way valve means being disposed within a respective housing between said respective outlet opening and said respective outlet port.

12. The pulse charging system of claim 11 wherein at least one of said plurality of first one-way valve means comprises at least one reed valve.

13. The pulse charging system of claim 12 wherein said at least one reed valve is a dual-stage reed valve.

14. The pulse charging system of claim 11 wherein at least one of said plurality of first one-way valve means comprises at least one check valve.

15. The pulse charging system of claim 11 wherein at least one of said plurality of second one-way valve means comprises at least one reed valve.

16. The pulse charging system of claim 15 wherein said at least one reed valve is a dual-stage reed valve.

17. The pulse charging system of claim 11 wherein at least one of said plurality of second one-way valve means comprises at least one check valve.

18. The pulse charging system of claim 11 further comprising means for blowing air into said inlet port of at least one of said plurality of housings.

19. The pulse charging system of claim 11 wherein at least one of said housings is fixedly secured to said crankcase of said internal combustion engine.

20. The pulse charging system of claim 11 wherein at least one of said housings is integral with said crankcase of said internal combustion engine.

* * * * *